US005592968A

United States Patent [19]

Nakashima et al.

[11] Patent Number: 5,592,968

[45] Date of Patent: Jan. 14, 1997

[54] PRESSURE SUPPLY DEVICE

[75] Inventors: Tatsushi Nakashima, Nishio; Tsutomu Furuhashi, Kariya; Hiroyuki Kano, Nagoya; Kazuo Yamamoto, Kariya; Hiroshi Inoue, Chiryu, all of Japan

[73] Assignee: Nippondenso Co., Ltd., Kariya, Japan

[21] Appl. No.: 317,364

[22] Filed: Oct. 4, 1994

[30] Foreign Application Priority Data

Oct. 6, 1993 [JP] Japan ..... 5-250545

[51] Int. Cl.[6] ..... F02M 55/02

[52] U.S. Cl. ..... 137/561 A; 123/456

[58] Field of Search ..... 137/561 A, 597; 123/456, 468, 469, 470

[56] References Cited

U.S. PATENT DOCUMENTS

| | | | |
|---|---|---|---|
| 3,507,263 | 4/1970 | Long | 123/456 X |
| 4,512,368 | 4/1985 | Kaminaka et al. | 137/561 A |
| 5,197,436 | 3/1993 | Ozawa | 123/456 |
| 5,311,850 | 5/1994 | Martin | 137/561 A X |

FOREIGN PATENT DOCUMENTS

| | | | |
|---|---|---|---|
| 308355 | 10/1992 | Japan | 123/468 |
| 4330373 | 11/1992 | Japan . | |

OTHER PUBLICATIONS

Masahiko Miyaki et al, "Development of New Electronically Controlled Fuel Injection System ECD-U2 For Diesel Engines" SAE Technical Paper series 910252, pp. 1–17, Feb. 25–Mar. 1, 1991.

Isao Osuka et al, "Benefits of New Fuel. . ." SAE Technical paper series 940586, pp. 7–17, Feb. 28–Mar. 3, 1994.

*Primary Examiner*—Stephen M. Hepperle
*Attorney, Agent, or Firm*—Cushman Darby & Cushman

[57] ABSTRACT

An apparatus and method for applying constant pressure to a plurality of pressure demanding mechanisms is disclosed. The apparatus includes a common rail, a plurality of pressure demanding mechanisms, a pressure supply source, and a plurality of branching paths. The lengths of the pressure supply path Lp, the pressure propagation path in the common rail, Lc, and the pressure branching paths, Li, are chosen so as to satisfy the following formulae, which leads to reductions in pressure fluctuations:

$$(2n+0.5)Lp \leqq Lc \leqq (2n+1.5)Lp$$

$$(2n+1.5)Lp \leqq Li \leqq (2n+2.5)Lp, \text{ where } (n=0, 1, 2, \ldots).$$

6 Claims, 4 Drawing Sheets

FIG. IA
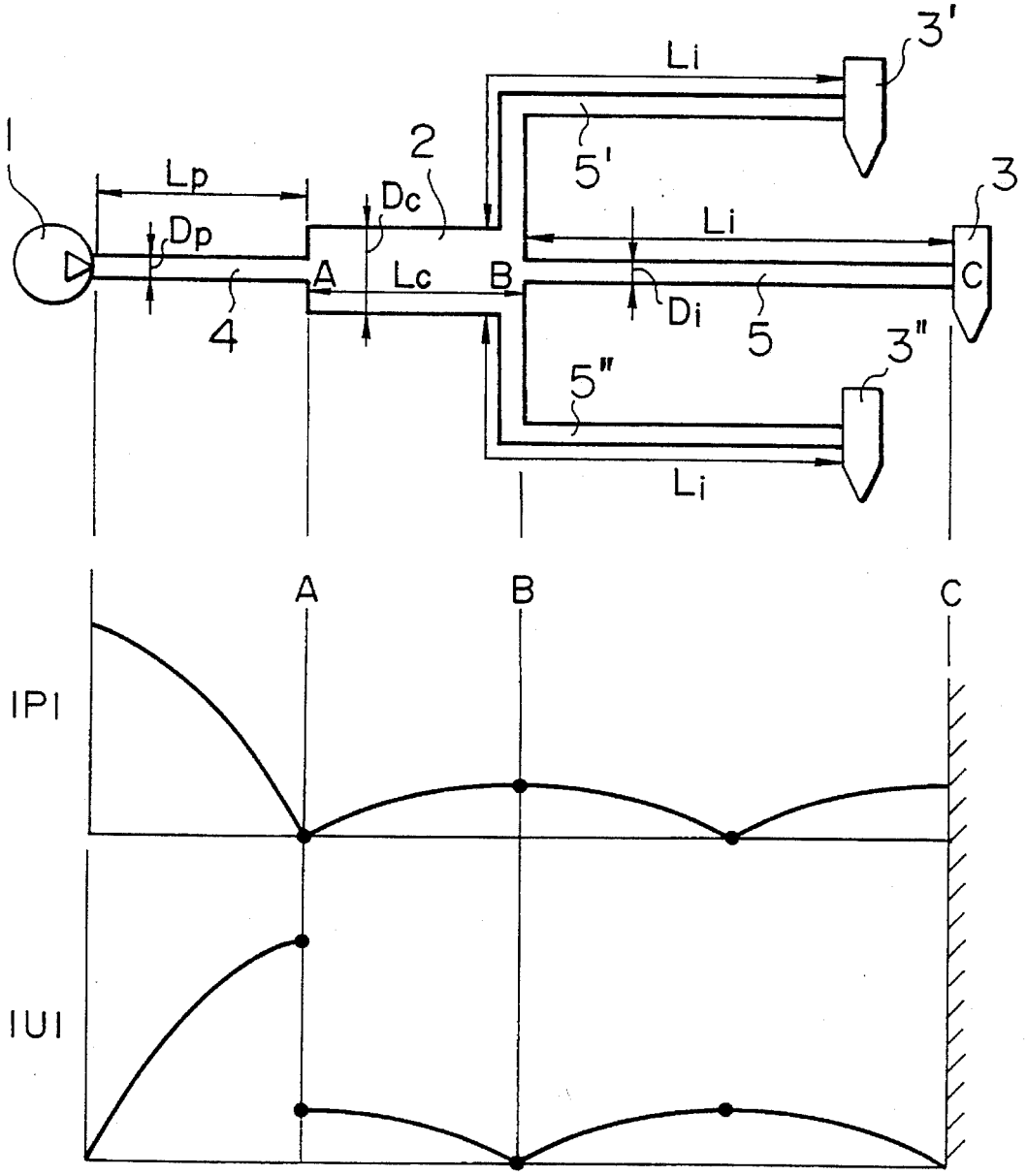
FIG. IB

PRESSURE SUPPLY DEVICE

CROSS REFERENCE TO RELATED APPLICATIONS

This application is based upon and claims priority from Japanese Patent Application 5-250545 filed Oct. 6, 1993, the contents of which are hereby incorporated herein by reference.

BACKGROUND OF THE INVENTION

1. Field of the Invention

The present invention relates to pressure supply equipment, which supplies pressure consistently to a plurality of pressure demanding mechanisms. More specifically, the pressure supply device can be utilized on a pressure supply equipment for fuel injection of internal combustion engines.

2. Related Art

Conventional kinds of pressure supply devices adapted for fuel injection in internal combustion engines has been disclosed in Japanese Patent Laid-Open No. 4-330373. The device disclosed therein relates to a common rail type fuel injection device. The device attempts, by the provision of a dividing bulkhead having an orifice near the center in the longitudinal direction of the common rail, to prevent a change in pressure generating inside the common rail at one side from propagating into the common rail at another side in order to prevent fluctuations in the amount of fuel injection among respective cylinders of an internal combustion engine.

In such a conventional device, in which one common rail is shared by plural number of fuel injection valves, pulsating pressure resulting from fuel discharge from a fuel tank propagates through fuel paths as wave motion and influences the amount of fuel injected from fuel injection valves. The pulsating pressure is generated because the discharge from a high pressure fuel pump acts as an exciting source for a water hammer and the resulting resonance frequencies induce pressure vibrations in the paths including the fuel injection valves, common rail and fuel pump. Further, because the manner of propagation of pulsating pressure to respective injection valves varies depending upon the distance of the fuel paths in the common rail to each cylinder, such a pulsating pressure produces fluctuations in the amounts injected to the respective cylinders.

SUMMARY OF THE INVENTION

An object of the present invention is to provide a pressure supply device for fuel injection in internal combustion engines that can reduce the pulsating pressure resulting from reasons such as those described above.

In order to achieve the above-specified object, according to the present invention, the present inventors have developed a pressure supply device, which supplies pressure to a plurality of pressure demanding mechanisms, including a tubular common rail which accumulates pressure to be supplied to the plurality of pressure demanding mechanisms, a pressure supply source for supplying pressure to the common rail, a plurality of pressure branching paths that independently connect one end of the common rail to the plurality of pressure demanding mechanisms and have an extremely fine diameter compared with that of the common rail, and, where the length of the pressure supply side paths is Lp, the length of pressure transmitting paths in the common rail is Lc, and the length of the pressure branching paths is Li, approximately satisfies the following formulae:

$$(2n+0.5)Lp \leqq Lc \leqq (2n+1.5)Lp$$

$$(2n+1.5)Lp \leqq Li \leqq (2n+2.5)Lp, \text{ where } (n=0, 1, 2, \ldots).$$

Such a construction reduces pressure fluctuations generated at the entrance of the pressure demanding mechanisms by means of the pressure supply source acting as an exciting source.

If pressure is applied from the pressure supply source, according to the present invention, the applied pressure propagates through the pressure propagating paths accompanying pressure fluctuations. Where the path length at the pressure supply side is Lp, the length of the pressure propagating path in the common rail is Lc and the length of the pressure branching path is Li, the applied pressure passes through the paths which are set so that the lengths approximately satisfy the following formulae:

$$(2n+0.5)Lp \leqq Lc \leqq (2n+1.5)Lp$$

$$(2n+1.5)Lp \leqq Li \leqq (2n+2.5)Lp, \text{ where } (n=0, 1, 2, \ldots).$$

The pressure fluctuation is reduced while the pressure propagates to the plurality of pressure demanding mechanisms.

According to the present invention, because the pressure fluctuations along the propagation routes can be reduced, the fluctuations in pressure propagating to the plurality of pressure demanding mechanisms can also be reduced.

BRIEF DESCRIPTION OF THE DRAWINGS

Other objects, features, and characteristics as well as the functions of related elements will become apparent to a person of ordinary skill in the art from study of the following detailed description, the appended claims, and the drawings. In the drawings:

FIGS. 1A and 1B show the structure of the first embodiment according to the present invention, and also the relationship between the width of pulsating pressure and the width of fuel flow speed fluctuation;

DETAILED DESCRIPTION OF THE PRESENTLY PREFERRED EXEMPLARY EMBODIMENTS

Figure 2A:
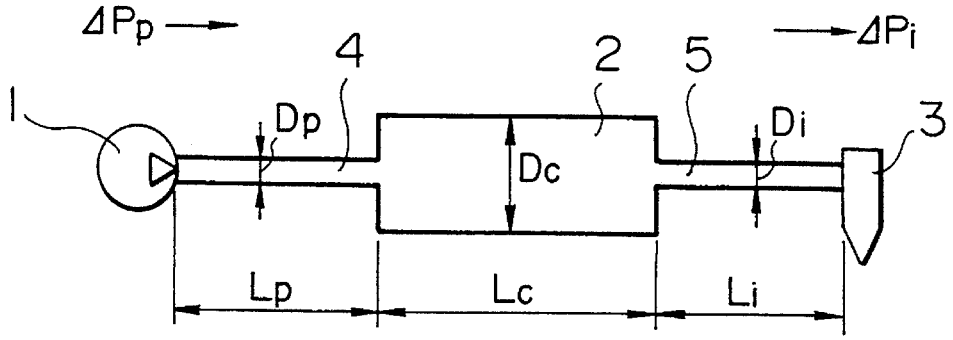
FIGS. 2A and 2B show the pipe length ratio of fuel injection paths and also the effect of reduction in pressure pulsation.

The first embodiment of the present invention will be described with reference to FIG. 1.

An accumulator type fuel injector, as shown in FIG. 1, has a plurality of fuel injection valves 3, 3' and 3" (hereinafter collectively called "3"). Fuel injection valves 3 are connected respectively to one end of common rail 2 by pipes 5, 5' and 5" (hereinafter collectively called "5"). To the other end of common rail 2, one end of pipe 4 at a pump side is connected. Furthermore, the other end of pipe 4 disposed on the pump side is connected to pump 1. It should be noted that the inside diameter of pipe 4 at pump side and pipe 5 at the side of the injection valves 3 are very fine compared with that of common rail 2. The relationship of the diameters of pipe 4, pipe 5, and common rail 2 is Dp<Dc, Di<Dc.

On the fuel injector, which is constructed as described above, where the length of pipe at pump side is Lp, the length of the pressure propagating path in the common rail is Lc, and the length of the pipe at fuel injection valve is Li, if the pipe length at pump side, Lp, is taken as the standard, Lc and Li can be set approximately as shown below, so as to satisfy the formulae:

$$(2n+0.5)Lp \leqq Lc \leqq (2n+1.5)Lp$$

$$(2n+1.5)Lp \leqq Li \leqq (2n+2.5)Lp, \text{ where } (n=0, 1, 2, \ldots).$$

This will be described later in more detail.

Figure 4:
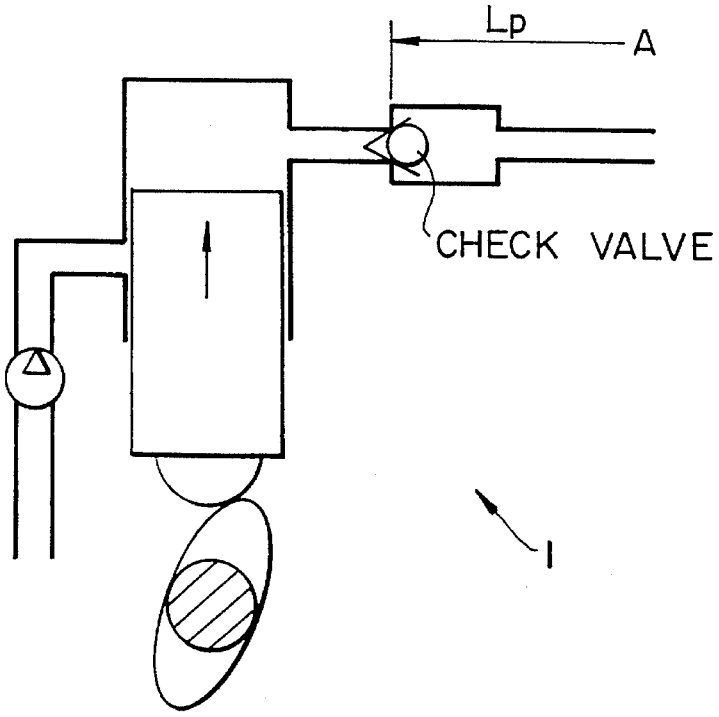
FIG. 4 is a schematic view of the fuel pump.
Figure 5:
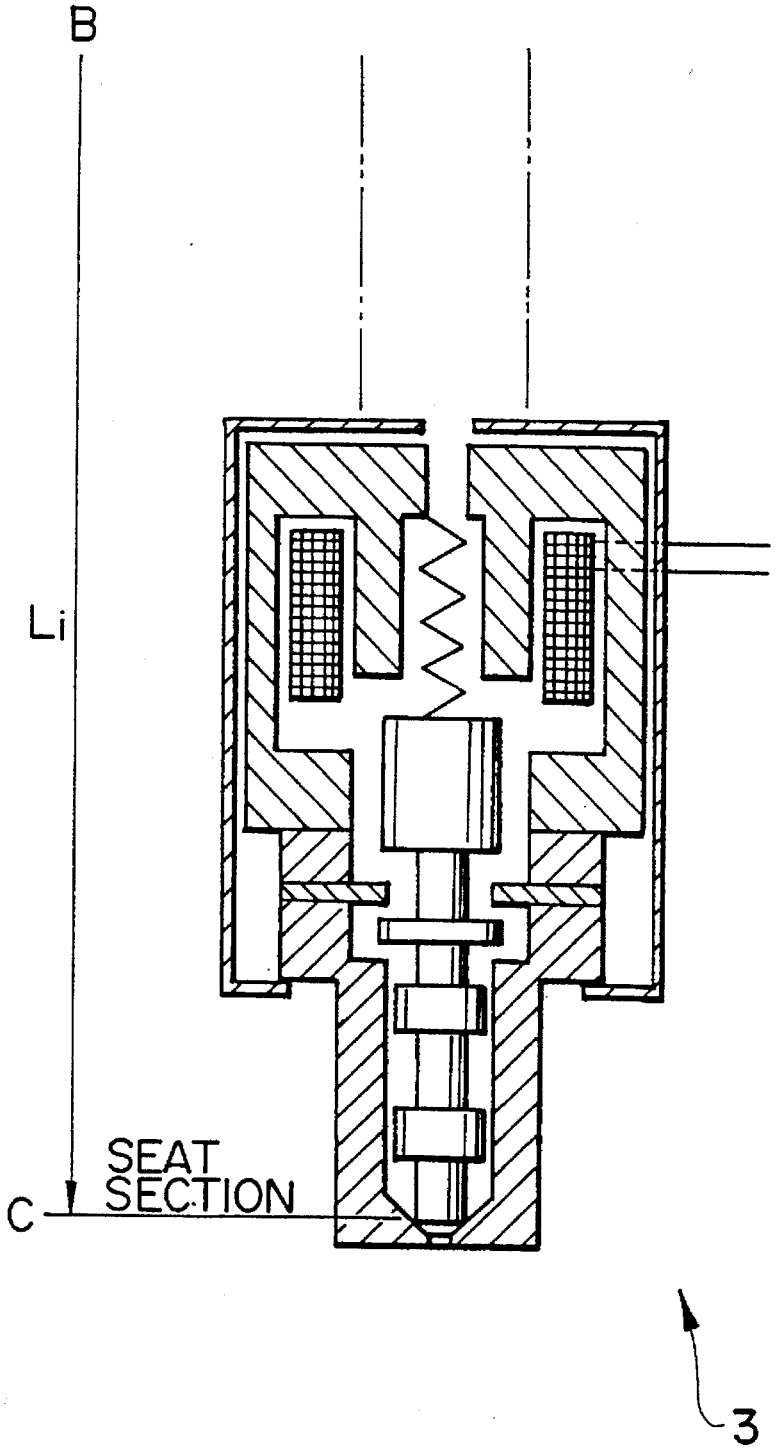
FIG. 5 is a schematic view of the fuel injection valve.

Description of a detailed example will be provided with respect to a detailed example in which the pipe length is Lp=Lc=Li/2 as shown in FIG. 1. Regarding the pipe length, note that the pipe length at pump side, Lp, represents the length from a check valve built in the fuel pump as shown in FIG. 4 to the entrance of common rail where the diameter of fuel path increases from Dp to Dc, and the length of pipe at injection valve side, Li, represents the length from the exit of common rail where the diameter of fuel path decreases, to a seat section built in the fuel injection valve shown in FIG. 5.

When fuel is discharged from fuel pump 1, the resulting water hammer wave generates resonance frequencies in the fuel path, which in turn induce a pulsating pressure wave in pipe 4 at the pump side, common rail 2, and pipe 5 at fuel injection valve side. The width of the pulsating pressure |P| is distributed as shown in FIG. 1. This can be derived easily if the entrance of fuel injection valve 3 (point C in FIG. 1) is considered to be a closed end (width of flow speed fluctuation |U|=0) and the entrance (point A in FIG. 1) and the exit (point B in FIG. 1) of common rail 2 are taken as poles.

Since, with the pipe length ratio in the first embodiment, the flow speed becomes maximum at point A, the width of propagating pulsation pressure receives the reducing effect by an increased cross-section and the pressure permeates into the common rail 2. Since the flow speed |U| becomes minimum at the point B, the width of propagating pulsation pressure from fuel pump 1 is suppressed in terms of increasing effect by a reduced cross-section and the pressure permeates into the pipe at the injection valve side. Therefore, if the pipe length ratio is set as described above, the pulsating pressure which generates from fuel pump 1 and propagates to the fuel injection valve 3 can be reduced.

Figure 2B:
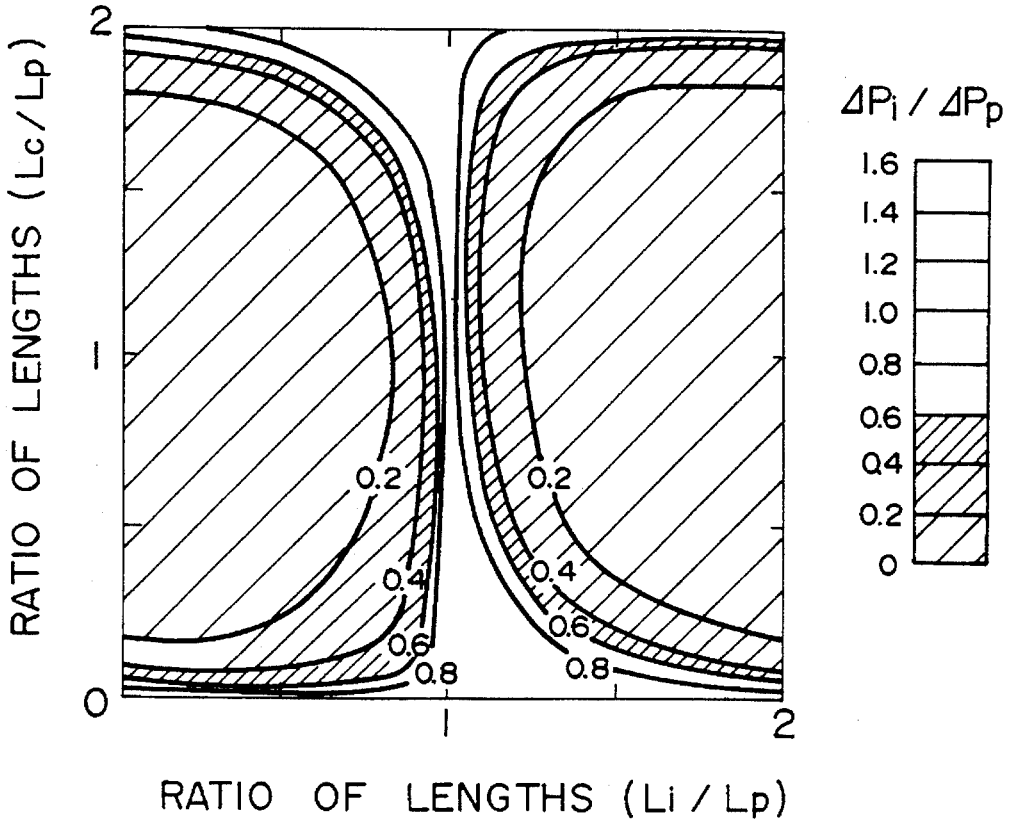

As is learned from the first embodiment described above, the pulsating pressure |P| related to resonance frequencies on the fuel path varies depending on the pipe length. Accordingly, using a simplified model in which fuel pump 1, pipe 4 at pump side, common rail 2, pipe 5 at injection valve side and fuel injection valve 3 are connected in series as shown in FIG. 2A, the reducing effect on the width of pulsating pressure depending on the pipe length, ΔPi/ΔPp, where ΔPp is the width of pulsating pressure at discharge section of fuel pump 1 and ΔPi is the width of pulsating pressure at an entrance section of injection valve 3, is shown in FIG. 2B. As a result, it is shown that the reducing effect on the pulsating pressure increases approximately as follows, $$(2n+0.5)Lp \leqq Lc \leqq (2n+1.5)Lp$$

$$(2n+1.5)Lp \leqq Li \leqq (2n+2.5)Lp, \text{ where } (n=0, 1, 2, \ldots).$$

Figure 3:
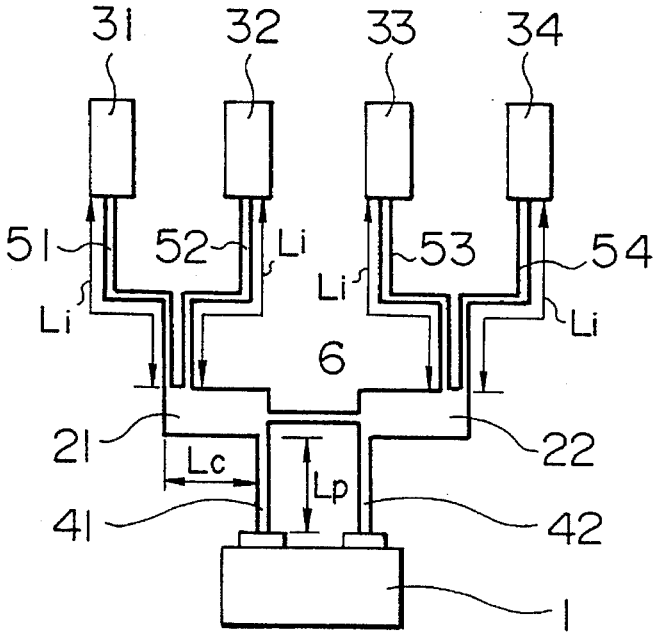
FIG. 3 is a block diagram of the second embodiment according to the present invention.

Next, the second embodiment in which the fuel pump has two cylinders and four fuel injection valves 31 are provided is explained based on FIG. 3.

Each cylinder of fuel pump 1 is connected to one end of divided common rails 21 and 22 by pipes 41 and 42 both at the fuel pump side. This arrangement allows suppression of interference of pulsating pressure by the discharge from each fuel pump cylinder.

Further, fuel injection valves 31, 32, 33 and 34 are connected to the other ends of common rails 21 and 22 by pipes 51, 52, 53 and 54 all at fuel injection valve side. It should be noted that the pipe branching section at injection valve side is branched radially from the center axis of inner diameter of the common rail in order to assimilate the length of pressure propagating paths.

The ratio of respective pipe lengths, which is same as that disclosed in the first embodiment, is employed in this embodiment. Further, taking into consideration the reducing effect on the pulsating pressure, a common rail is shared by groups on which the sequence of fuel injection does not occur from one group to the next and besides it is so arranged that any fuel pump cylinders on the same path as a fuel injection valve will not discharge fuel simultaneously with the fuel injection from the said fuel injection valve.

Furthermore, pipe 6 is used to connect common rails 21 and 22 so as to ensure a fuel supply to either common rail to which, when trouble occurs on either cylinder of the fuel pump 1, the cylinder in trouble is connected. Note that pipe 6 has an extremely fine inside diameter compared with that of common rails 21 and 22 in order to suppress the permeation of pulsating pressure between the common rails 21 and 22.

The above embodiments enable a consistent reduction in the pulsating pressure which occurs on the fuel injectors of an internal combustion engine. That is, it enables more accurate control of the amount of fuel injected into the engine.

Although the above embodiments referred to the fuel injectors of internal combustion engines, the same reducing effect on the pulsating pressure can be obtained also on the pressure waves as well as sound waves of not only the fuel but also any other fluids.

The present invention has been described in connection with what are presently considered to be the most practical and preferred embodiments. However, this invention is not meant to be limited to the disclosed embodiments, but rather is intended to cover various modifications and alternative arrangements included within the spirit and scope of the appended claims.

What is claimed is:

1. A pressure supply apparatus, comprising:

a tubular common rail that accumulates pressure to be distributed;

a pressure supply source to supply pressure to said common rail;

a plurality of pressure branching paths that connect independently one end of said common rail to an external pressure sink, and have a diameter smaller than that of said common rail; and wherein the following equations (1) and (2) are satisfied:

$$(2n+0.5)Lp \leqq Lc \leqq (2n+1.5)Lp \quad (1)$$

$$(2n+1.5)Lp \leqq Li \leqq (2n+2.5)Lp, \text{ where } (n=0 \text{ or a natural number}) \quad (2)$$

with Lp representing the length of pressure supply side paths, Lc representing the length of pressure propagation path in said common rail, and Li representing the length of said pressure branching paths, each pressure supply side path beginning from at a point where path diameter changes from a pump side and each pressure branching path ending at a second point where path diameter changes, whereby pressure fluctuations generated at said pressure sink with said pressure supply source acting an exciting source is suppressed.

2. A method for reducing pressure fluctuations in a pressure supply apparatus, comprising the steps of:

providing a pressure supply apparatus including a plurality of pressure demanding mechanisms, a tubular common rail, a pressure supply for said common rail, and a plurality of pressure branching paths that connect independently one end of said common rail to said plurality of pressure demanding mechanisms, each pressure supply side path beginning at a point where path diameter changes from a pump side and each pressure branching path ending at a second point where path diameter changes; and ensuring that lengths of a pressure supply side path, Lp, a pressure propagation path in said common rail, Lc and said pressure branching paths, Li, approximately satisfy the following formulae (1) and (2):

$$(2n+0.5)Lp \leqq Lc \leqq (2n+1.5)Lp \quad (1)$$

$$(2n+1.5)Lp \leqq Li \leqq (2n+2.5)Lp, \text{ where } (n=0 \text{ or a natural number}) \quad (2).$$

3. A pressure supply apparatus, comprising:

a plurality of pressure demanding mechanisms;

a tubular common rail that accumulates pressure to be supplied to said plurality of pressure demanding mechanisms;

a pressure supply source to supply pressure to the said common rail;

a plurality of pressure branching paths that connect independently one end of said common rail to said plurality of pressure demanding mechanisms, and have a diameter smaller than that of said common rail; and which approximately satisfies the following equations (1) and (2):

$$(2n+0.5)Lp \leqq Lc \leqq (2n+1.5)Lp \quad (1)$$

$$(2n+1.5)Lp \leqq Li \leqq (2n+2.5)Lp, \text{ where } (n=0 \text{ or a natural number}) \quad (2)$$

wherein Lp represents the length of pressure supply side paths, Lc represents the length of pressure propagation paths in the said common rail, and Li represents the length of said pressure branching paths, each pressure supply side path beginning at a point where path diameter changes from a pump side and each pressure branching path ending at a second point where path diameter changes; and wherein said pressure supply apparatus is so constructed so as to reduce pressure fluctuations generated at an entrance of said pressure demanding mechanisms with said pressure supply source acting an exciting source.

4. A pressure supply apparatus as in claim 1, wherein said first point comprises a check valve built in the pressure supply source and wherein said second point is a seat section built in said external pressure sink.

5. A method as in claim 2, wherein said first point comprises a check valve built in the pressure supply source and wherein said second point is a seat section built in said external pressure sink.

6. A pressure supply apparatus as in claim 3, wherein said first point comprises a check valve built in the pressure supply source and wherein said second point is a seat section built in said external pressure sink.

* * * * *